United States Patent [19]

Kalkert

[11] Patent Number: 4,922,214

[45] Date of Patent: May 1, 1990

[54] APPARATUS TO COUPLE LASER RADIATION AND MICROWAVE ENERGY USING A MICROWAVE WAVEGUIDE

[75] Inventor: Peter Kalkert, Jülich, Fed. Rep. of Germany

[73] Assignee: URANIT GmbH, Jülich, Fed. Rep. of Germany

[21] Appl. No.: 216,723

[22] Filed: Jul. 8, 1988

[30] Foreign Application Priority Data

Jul. 10, 1987 [DE] Fed. Rep. of Germany ..... 3722850

[51] Int. Cl.[5] ..... H01P 1/213

[52] U.S. Cl. ..... 333/135; 333/137

[58] Field of Search ..... 333/126, 129, 134, 135, 333/137; 343/725; 372/108, 64, 65

[56] References Cited

U.S. PATENT DOCUMENTS

| | | | |
|---|---|---|---|
| 2,963,663 | 12/1960 | Marcatili | 333/135 |
| 3,441,878 | 4/1969 | Standley | 333/135 |
| 4,725,796 | 12/1988 | Youree et al. | 333/135 |

*Primary Examiner*—Eugene R. Laroche
*Assistant Examiner*—Benny Lee
*Attorney, Agent, or Firm*—Nils H. Ljungman

[57] ABSTRACT

An apparatus for the coupling of laser radiation into a microwave waveguide, in which the laser radiation and the microwave enter the waveguide perpendicular to one another and, after the microwave is deflected, exit the waveguide colinearly. To enlarge the cross section of the laser beam to be coupled and to be able to adjust it to the microwave waveguide, the invention provides that the entry aperture for the laser beam incorporates a corrugated bandstop filter, and that the entry aperture for the microwave is configured in the manner of an orthomode coupler.

20 Claims, 1 Drawing Sheet

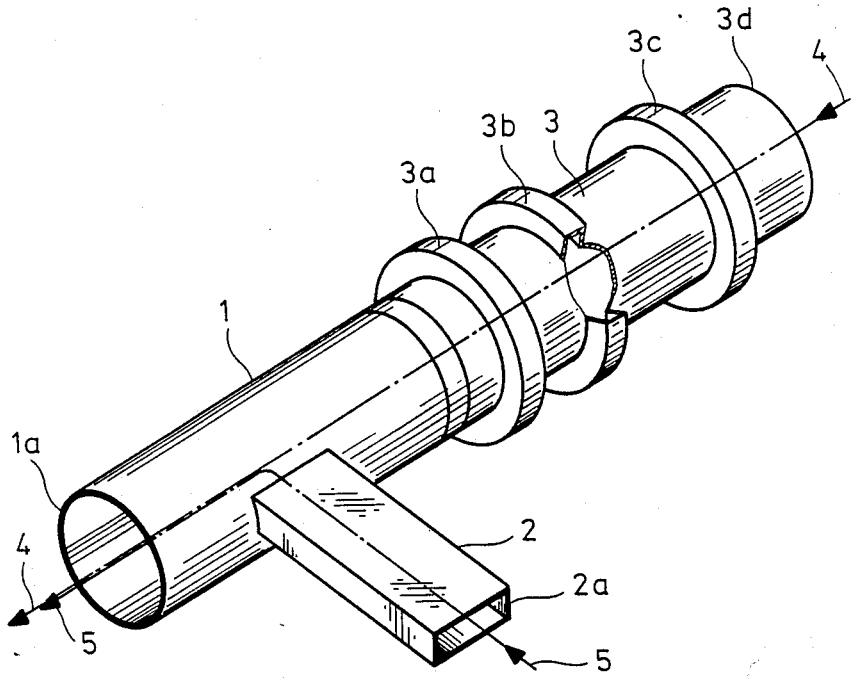
3d
3c
4
3b
3
3a
1
1a
2
4
2a
5
5

APPARATUS TO COUPLE LASER RADIATION AND MICROWAVE ENERGY USING A MICROWAVE WAVEGUIDE

BACKGROUND OF THE INVENTION

1. Field of the Invention

The present invention relates to an apparatus to couple laser radiation into a microwave waveguide or other microwave structure.

2. Description of the Prior Art

For uranium isotope separation, a laser wavelength for isotope-selective excitation is required which cannot be set with the required precision using fixed frequency lasers known in the prior art.

The prior art includes electrooptic modulation, a method by means of which the desired wavelengths can be produced utilizing frequency shift principles. If the required modulation frequencies are in the microwave range, it is necessary to incorporate an electrooptic modulator crystal into a microwave waveguide, so that the laser beam and modulating microwave can pass through the electrooptic modulator crystal substantially colinearly. Using this method, it is difficult to couple the laser radiation into the microwave waveguide.

Devices known in the prior art couple a laser beam by means of a hole provided in a microwave elbow [See, for example, Appl. Phys. Lett. 34(7), Apr. 1, 1979, Page 452, FIG. 1. This prior art publication is hereby expressly incorporated by reference as if the entire contents thereof were fully set forth herein.] Using this method, this hole may have only small dimensions, as compared to the dimensions of the hollow conductor, in order not to interfere with the microwave mode and in order to prevent undesirable reflection.

This means that the laser beam must be focused through the provided coupling hole. With the energies required for an industrial process, this produces problems with breakdowns and arcing in the vicinity of the coupling hole. Moreover, it is difficult to adjust the laser beam to the geometry of the microwave waveguide, in order that the beam will illuminate, as much as possible, the cross sectional area of the electrooptic crystal. This is necessary, however, to obtain a high degree of efficiency with simultaneously high laser power.

Examples of issued U.S. patents which generally discuss the modulation of laser radiation with microwave radiation are U.S. Pat. No. 4,208,091, issued June 17, 1980 and entitled "Broadband Microwave Waveguide Modulator for Infrared Lasers" and U.S. Pat. No. 4,118,676, issued Oct. 3, 1978 and entitled "Method and Apparatus for Driving an Optical Waveguide with Coherent Radiation", both of these issued U.S. patents being hereby expressly incorporated by references as if the entire contents thereof were fully set forth herein.

OBJECT OF THE INVENTION

One object of the present invention is the provision of an improved coupling device of the type described above, so that a laser beam can be coupled, the cross section of which may be relatively easily adjusted to that of the microwave waveguide. The invention disclosed herein makes possible a blocking of the microwave in the direction of the entry aperture of the laser beam, so that this aperture can have practically the same cross section as the common exit aperture of the microwave waveguide.

SUMMARY OF THE INVENTION

In general, the invention features a coupling device for coupling laser radiation and microwave radiation, the coupling device including a microwave waveguide apparatus for guiding the microwave radiation along a substantially defined path, and the microwave waveguide apparatus having a microwave entry aperture and a common exit aperture for both the microwave radiation and the laser radiation. A laser entry aperture apparatus is provided in the microwave waveguide apparatus for admitting the laser radiation into the interior of the microwave waveguide apparatus. A bandstop filter apparatus substantially reduces any emission of the microwave radiation via the laser entry aperture apparatus.

In a preferred embodiment, the invention features a coupling device for coupling laser radiation and microwave radiation, the coupling device including a microwave waveguide apparatus which has a first hollow tube-shaped member, the microwave waveguide apparatus also having a microwave entry aperture and a common exit aperture for both the microwave radiation and the laser radiation. A laser entry aperture apparatus is provided in the microwave waveguide apparatus for admitting the laser radiation into the interior of the microwave waveguide apparatus. The laser entry apparatus and the common exit aperture for both the microwave radiation and the laser radiation are substantially aligned with the major longitudinal axis of the first hollow tube-shaped member. The microwave entry aperture includes an opening in the first hollow tube-shaped member and a second hollow tube-shaped member interconnecting with the first hollow tube-shaped member and surrounding the opening. The first hollow tube-shaped member has a substantially circular cross sectional profile, and the second hollow tube-shaped member has a substantially rectangular cross sectional profile. The second hollow tube-shaped member extends substantially perpendicular to the major longitudinal axis of the first hollow tube-shaped member. The preferred embodiment of the coupling device also includes a bandstop filter apparatus for substantially reducing any emission of the microwave radiation via the laser entry aperture apparatus, the bandstop filter apparatus including an extension of the first hollow tube-shaped member which has a plurality of outstanding annular ribs spaced from one another in the direction of the major longitudinal axis of the first hollow tube-shaped member, each of the plurality of outstanding annular ribs having a sharp edged U-shaped cross sectional profile.

BRIEF DESCRIPTION OF THE DRAWING

A preferred embodiment of the invention is illustrated in the sole accompanying FIGURE, and is explained in detail below.

DETAILED DESCRIPTION OF THE PREFERRED EMBODIMENTS

As shown in the figure, a microwave waveguide configured according to the invention generally includes an orthomode coupler, e.g. made of copper, comprising a tube 1 with a circular cross section and a tube 2 having a rectangular cross section connected perpendicular to tube 1. Additionally connected to the tube 1, is a tubular bandstop filter 3, also having a circular cross section. The bandstop filter 3 has several corrugations 3*a*, 3*b*, 3*c* pointing radially outward which, when viewed in cross section, have a sharp edged, U-shaped configuration, and which are located at different axial distances from one another.

The laser beam 4 enters through an aperture 3*d* of the bandstop filter 3 and exits the tube 1 of the microwave waveguide through a common exit aperture 1*a*. The microwave 5 enters through an entry aperture 2*a* into the rectangular tube 2 of the microwave waveguide, is deflected in the tube 1 and exits the tube 1 through the common exit aperture 1*a*. In a microwave waveguide which operates at approximately 16 GHz, using a known prior art coupling device of the type described above, the hole for the laser beam may have a maximum diameter of only 6 to 8 mm for a microwave waveguide diameter of approximately 14 mm. In contrast, in an arrangement configured according to the present invention, the entry aperture 3*d* of the bandstop filter 3 may, under similar conditions, have an open diameter of about 12 mm, therefore allowing the use of higher powered lasers, as well as permitting an easier adjustment of the laser beam 4 to the geometry of the orthomode coupler 1, 2. The microwave 5 is thereby deflected toward the common exit aperture 1*a* with practically no loss in the coupler.

The invention as described hereinabove in the context of a preferred embodiment is not to be taken as limited to all of the provided details thereof, since modifications and variations thereof may be made without departing from the spirit and scope of the invention.

What is claimed is:

1. A coupling device for coupling laser radiation and microwave radiation and directing the coupled laser radiation and microwave along a predetermined path, said coupling device comprising:

microwave waveguide means for guiding the microwave radiation along substantially said predetermined path, said microwave waveguide means having a microwave entry aperture and a common exit aperture for both the microwave radiation and the laser radiation, said common exit aperture having a predetermined cross-sectional dimension;

laser entry aperture means provided in said microwave waveguide means for admitting the laser radiation into the interior of said microwave waveguide means, said laser entry aperture means having a cross-sectional dimension comparable to said predetermined cross-sectional dimension of said common exit aperture and bandstop filter means positioned in said microwave waveguide means between said laser entry aperture means and said microwave entry aperture for substantially reducing any emission of the microwave radiation through said laser entry aperture means.

2. A coupling device according to claim 1, wherein said microwave waveguide means comprises a first hollow tube-shaped member having a major longitudinal axis, said laser entry aperture means and said common exit aperture for both the microwave radiation and the laser radiation being substantially aligned with the major longitudinal axis of said first hollow tube-shaped member, and wherein said microwave entry aperture comprises an opening in said first hollow tube-shaped member.

3. A coupling device according to claim 2, wherein said bandstop filter means comprises a longitudinal extension of said first hollow tube-shaped member, said extension of said first hollow tube-shaped member having at least one annular extension projecting therefrom, and wherein said bandstop filter means is located adjacent to said laser entry aperture means.

4. A coupling device according to claim 2, wherein said microwave entry aperture further comprises a second hollow tube-shaped member interconnecting with said first hollow tube-shaped member so as to surround said opening providing said microwave entry aperture.

5. A coupling device according to claim 3, wherein said microwave entry aperture further comprises a second hollow tube-shaped member interconnecting with said first hollow tube-shaped member so as to surround said opening providing said microwave entry aperture.

6. A coupling device according to claim 4, wherein said first hollow tube-shaped member has a substantially circular cross section, and wherein said second hollow tube-shaped member has a substantially rectangular cross section.

7. A coupling device according to claim 5, wherein said first hollow tube-shaped member has a substantially circular cross section, and wherein said second hollow tube-shaped member has a substantially rectangular cross section.

8. A coupling device according to claim 1, wherein said laser entry aperture means and said common exit aperture are both substantially circular, and wherein said microwave entry aperture is substantially rectangular.

9. A coupling device according to claim 4, wherein said second hollow tube-shaped member has a major longitudinal axis which extends substantially perpendicular to the major longitudinal axis of said first hollow tube-shaped member.

10. A coupling device according to claim 5, wherein said second hollow tube-shaped member has a major longitudinal axis which extends substantially perpendicular to the major longitudinal axis of said first hollow tube-shaped member.

11. A coupling device according to claim 3, wherein said at least one annular extension projecting from said first hollow tube-shaped member comprises at least two annular ribs extending radially outward from the exterior surface of said first hollow tube-shaped member, each of said at least two annular ribs having a substantially sharp edged U-shaped cross sectional configuration, and said at least two annular ribs being spaced from one another in the direction of the major longitudinal axis of said first hollow tube-shaped member.

12. A coupling device for coupling laser radiation and microwave radiation and directing the coupled laser radiation and microwave radiation along a predetermined path, said coupling device comprising:

microwave waveguide means for guiding the microwave radiation along substantially said predetermined path, said microwave waveguide means having a microwave entry aperture and a common exit aperture for both the microwave radiation and the laser radiation;

laser entry aperture means provided in said microwave waveguide means for admitting the laser radiation into the interior of said microwave waveguide means; and bandstop filter means positioned in said microwave waveguide means between said laser entry aperture means and said microwave entry aperture for substantially reducing any emission of the microwave radiation through said laser entry aperture means;

said microwave waveguide means comprising a first hollow tube-shaped member having a major longitudinal axis, said laser entry aperture means and said common exit aperture for both the microwave radiation and the laser radiation being substantially aligned with the major longitudinal axis of said first hollow tube-shaped member and wherein said microwave entry aperture comprises an opening in said hollow tube-shaped member;

said bandstop filter means comprising a longitudinal extension of said first hollow tube-shaped member, said extension of said first hollow tube-shaped member having at least one annular extension projecting therefrom, with said bandstop filter means being located adjacent to said laser entry aperture means;

said at least one annular extension projecting from said first hollow tube-shaped member comprising at least two annular ribs extending radially outward from the exterior surface of said first hollow tube-shaped member, each of said at least two annular ribs having a substantially sharp edged U-shaped cross-sectional configuration and said at least two annular ribs being spaced from one another in the direction of the major longitudinal axis of said first hollow tube-shaped member; and said at least two radially projecting annular ribs further comprise first, second and third annular ribs extending radially outward from the exterior surface of said first hollow tube-shaped member, said first, second and third annular ribs being sequentially spaced from one another in the direction of the major longitudinal axis of said first hollow tube-shaped member and the axial distance between said first and second annular ribs being substantially nonequal to the axial distance between said second and third annular ribs.

13. A coupling device according to claim 7, wherein said at least one annular extension projecting from said first hollow tube-shaped member comprises at least two annular ribs extending radially outward from the exterior surface of said first hollow tube-shaped member, each of said at least two annular ribs having a sharp edged U-shaped cross sectional configuration, and said at least two annular ribs being spaced from one another in the direction of the major longitudinal axis of said first hollow tube-shaped member.

14. A coupling device for coupling laser radiation and microwave radiation along a predetermined path, said coupling device comprising:

microwave waveguide means for guiding the microwave radiation along substantially said predetermined path, said microwave waveguide means having a microwave entry aperture and a common exit aperture for both the microwave radiation and the laser radiation;

laser entry aperture means provided in said microwave waveguide means for admitting the laser radiation into the interior of said microwave waveguide means; and bandstop filter means positioned in said microwave waveguide means between said laser entry aperture means and said microwave entry aperture for substantially reducing any emission of the microwave radiation through said laser entry aperture means;

said microwave waveguide means comprising a first hollow tube-shaped member having a major longitudinal axis of said first hollow tube-shaped member, with said microwave entry aperture comprising an opening in said hollow tube-shaped member;

said bandstop filter means comprising a longitudinal extension of said first hollow tube-shaped member, said extension of said first hollow tube-shaped member having at least one annular extension projecting therefrom, with said bandstop filter means being located adjacent to said laser entry aperture means;

said microwave entry aperture further comprising a second hollow tube-shaped member interconnecting with said first hollow tube-shaped member so as to surround said opening providing said microwave entry aperture;

said first hollow tube-shaped member having a substantially circular cross-section with said second hollow tube-shaped member having a substantially rectangular cross-section;

said at least one annular extension projecting from said first hollow tube-shaped member comprising at least two annular ribs extending radially outward from the exterior surface of said first hollow tube-shaped member, each of said at least two annular ribs having a sharp edged U-shaped cross-sectional configuration, and said at least two annular ribs being spaced from one another in the direction of the major longitudinal axis of said first hollow tube-shaped member;

said at least two radially projecting annular ribs further comprise first, second and third annular ribs extending radially outward from the exterior surface of said first hollow tube-shaped member, said first, second and third annular ribs being sequentially spaced from one another in the direction of the major longitudinal axis of said first hollow tube-shaped member and the axial distance between said first and second annular ribs being substantially nonequal to the axial distance between said second and third annular ribs.

15. A coupling device according to claim 1, being dimensional for microwave radiation which has a frequency on the order of about 16 GHz, and wherein said laser entry aperture means comprises a substantially circular passage having a diameter of about 12 mm.

16. A coupling device according to claim 3, being dimensional for microwave radiation which has a frequency on the order of about 16 GHz, and wherein said laser entry aperture means comprises a substantially circular passage having a diameter of about 12 mm.

17. A coupling device according to claim 2, wherein said laser entry aperture means comprises a portion of said first hollow tube-shaped member, wherein the microwave radiation has a frequency on the order of about 16 GHz, and wherein said portion of said first hollow tube-shaped member is substantially circular and has an internal diameter of about 12 mm.

18. A coupling device according to claim 7, wherein said laser entry aperture means comprises an portion of said first hollow tube-shaped member, wherein the microwave radiation has a frequency on the order of about 16 GHz, and wherein said portion of said first hollow tube-shaped member has an internal diameter of about 12 mm.

19. A coupling device according to claim 1, wherein said microwave waveguide means comprises an orthomode coupler for coupling the laser radiation and the microwave radiation.

20. A coupling device for coupling laser radiation and microwave radiation, said coupling device comprising:

microwave waveguide means comprising a first hollow tube-shaped member defining a major longitudinal axis, said microwave waveguide means having a microwave entry aperture and a common exit aperture for both the microwave radiation and the laser radiation;

laser entry aperture means provided in said microwave waveguide means for admitting the laser radiation into the interior of said microwave waveguide means;

said laser entry aperture means and said common exit aperture for both the microwave radiation and the laser radiation being substantially aligned with said major longitudinal axis of said first hollow tube-shaped member;

said microwave waveguide entry aperture comprising an opening in said first hollow tube-shaped member and a second hollow tube-shaped member interconnecting with said first hollow tube-shaped member and surrounding said opening;

said first hollow tube-shaped member having a substantially circular cross sectional profile and said second hollow tube-shaped member having a substantially rectangular cross sectional profile;

said second hollow tube-shaped member extending substantially perpendicular to said major longitudinal axis of said first hollow tube-shaped member; and bandstop filter means for substantially reducing any emission of the microwave radiation via said laser entry aperture means, said bandstop filter means comprising a longitudinal extension of said first hollow tube-shaped member, said extension of said first hollow tube-shaped member having a plurality of outstanding annular ribs spaced from one another in the direction of said major longitudinal axis of said first hollow tube-shaped member, and each of said plurality of outstanding annular ribs having a sharp edged U-shaped cross sectional profile.

* * * * *